US007904999B2

(12) United States Patent
Steinhaus

(10) Patent No.: US 7,904,999 B2
(45) Date of Patent: Mar. 15, 2011

(54) ADJUSTABLE TEMPORARY CASKET

(76) Inventor: Steve Steinhaus, Muskego, WI (US)

( * ) Notice: Subject to any disclaimer, the term of this patent is extended or adjusted under 35 U.S.C. 154(b) by 227 days.

(21) Appl. No.: 12/185,450

(22) Filed: Aug. 4, 2008

(65) Prior Publication Data

US 2009/0031931 A1 Feb. 5, 2009

Related U.S. Application Data

(60) Provisional application No. 60/963,150, filed on Aug. 2, 2007.

(51) Int. Cl.
*A61G 17/00* (2006.01)

(52) U.S. Cl. ..... 27/12; 27/35

(58) Field of Classification Search ..... 27/12, 2, 27/35; 5/200.1, 11, 509.1, 610–612; D99/2, D99/8; 110/341, 194; 220/629, 636
See application file for complete search history.

(56) References Cited

U.S. PATENT DOCUMENTS

| | | | | | |
|---|---|---|---|---|---|
| 2,848,781 | A | | 8/1958 | Slaughter, Jr. et al. | |
| 2,888,732 | A | | 6/1959 | Nelson | |
| 3,539,142 | A | | 11/1970 | Morand | |
| 3,653,104 | A | | 4/1972 | Nelson | |
| 3,692,267 | A | * | 9/1972 | Kronas et al. | 248/288.11 |
| 4,063,337 | A | * | 12/1977 | Havey, III | 27/2 |
| 4,070,737 | A | | 1/1978 | Peterson | |
| 4,123,831 | A | | 11/1978 | Covington | |
| 4,151,630 | A | | 5/1979 | Havey | |
| 4,156,956 | A | | 6/1979 | Partridge et al. | |
| 4,177,543 | A | * | 12/1979 | Angermann | 27/35 |
| 4,209,880 | A | | 7/1980 | Lidholm | |
| 4,332,064 | A | | 6/1982 | Foust | |
| 4,524,472 | A | | 6/1985 | Foust | |
| 4,621,395 | A | * | 11/1986 | Benoit | 27/12 |
| 4,788,757 | A | | 12/1988 | Bethune et al. | |
| 4,993,129 | A | * | 2/1991 | Underwood et al. | 27/12 |
| 5,231,741 | A | | 8/1993 | Maguire | |
| 5,307,545 | A | | 5/1994 | Stoltz | |
| 6,684,467 | B1 | * | 2/2004 | Walker | 27/35 |
| 6,725,510 | B1 | | 4/2004 | Clyburn | |
| 7,356,890 | B1 | * | 4/2008 | Sauder | 27/12 |
| 2007/0084028 | A1 | | 4/2007 | Cox et al. | |

* cited by examiner

*Primary Examiner* — William L. Miller
(74) *Attorney, Agent, or Firm* — Boyle Fredrickson, S.C.

(57) ABSTRACT

A temporary casket made substantially from burnable material, having a positionable inclining mechanism inside a casket shell. The temporary casket may be inserted into a formal, traditional casket where the temporary casket shell protects the traditional casket. Inside the temporary casket, a plank is attached by a clamp or bracket to an adjusting mechanism for adjusting the tilt angle between the plank and the floor of the casket shell. The mechanism also includes a vertical threaded rod that engages the clamp, allowing the rod to be rotatable and move the clamp axially along the rod to lift or lower the plank. This allows a funeral director to easily adjust the deceased to achieve the most "restful" state, and without jostling or appearing disrespectful to the deceased. After a service, the deceased, along with the temporary casket and the mechanism itself, may be cremated.

11 Claims, 5 Drawing Sheets

ADJUSTABLE TEMPORARY CASKET

CROSS-REFERENCE TO RELATED APPLICATIONS

This utility patent application claims the benefit of and priority to U.S. provisional application 60/963,150, filed Aug. 2, 2007, which is herein expressly incorporated by reference in its entirety, for all purposes.

STATEMENT REGARDING FEDERALLY SPONSORED RESEARCH OR DEVELOPMENT

--

BACKGROUND OF THE INVENTION

The present invention relates to a casket with an inclining mechanism and more particularly to a temporary casket for visitation services where the deceased will later be cremated.

When the deceased is to be cremated, often the family will also want a funeral service and/or a visitation. While in some cases, the family may purchase a traditional casket, this is usually cost prohibitive. Therefore, it is common to place the deceased in a "rental casket."

A rental casket is a traditional casket that has a "temporary casket" nested within the traditional casket. The temporary casket is normally a cardboard shell that fits within the rental casket. This temporary casket protects the rental casket. After the visitation, the deceased is removed along with the temporary casket, for cremation.

However, it is very disconcerting for family members to see their loved one in a temporary casket. It is especially upsetting to many people to see their loved one lying flat in a casket. This is because the family needs to look down into the casket to say their good-byes It is much more natural and comfortable to view the deceased when he or she appears to be sleeping. To do this, the deceased is often propped up so that the head is elevated. As such, many funeral directors use pillows, rolls, plastic piping and other materials underneath the deceased's body to prop it up to appear in a more restful position. However, these items can move around, which can be extremely upsetting if the deceased is moved or jostled. Also, when the props need to be removed in order to close the casket, it can appear disrespectful.

In the past, devices for adjusting the vertical height and tilt of the deceased within a casket have generally been limited to traditional caskets. In part, the adjustment mechanisms cannot be attached to cardboard temporary casket walls, and also are primarily made of metal materials. The latter problem prevents the mechanisms from being able to be cremated along with the temporary casket and the deceased.

SUMMARY OF THE INVENTION

The present invention is directed to a temporary casket, and having a positionable inclining mechanism inside a cardboard casket that is made substantially from burnable material. Inside the temporary casket, a plank is attached to a mechanism that can lift and lower the plank for inclining and reclining. This allows a funeral director to easily adjust the deceased to achieve the most "restful" state. After a service, the deceased, along with the temporary casket and the mechanism itself, may be cremated.

A temporary casket that is adjustable permits any traditional casket to be made into a "rental" casket. The temporary casket may be inserted into a formal, traditional casket where the temporary casket shell protects the traditional casket from unfortunate effects such as embalming fluid leaks. The deceased rests inside the casket shell, on an adjustable plank. The adjusting mechanism is at the head of the deceased, but it is hidden behind pillows and linens for the wake, visitation and/or funeral service.

After the services, the casket shell containing the deceased may be removed, thereby allowing the deceased's family to refrain from having to purchase an expensive wood or metal casket for a viewing. Afterwards, the temporary casket may be cremated with the deceased.

Cremation is an alternative to the internment of an intact body in a casket. However, it may appear disrespectful to remove a deceased person from a casket to cremate, or alternatively to have to dig out the items that are used to prop a person up into a traditional "restful" state. Therefore, the present invention incorporates fully combustible materials that can be incinerated along with the deceased at the crematorium.

In one embodiment, a cardboard casket shell encases a wooden plank, or bed. There is an adjusting mechanism for adjusting the tilt angle between the plank and the floor of the casket shell. The adjusting mechanism includes a clamp, bracket, or other affixing device, affixed to the end of the plank. The mechanism also includes a vertical threaded rod that engages the clamp, allowing the rod to be rotatable and move the clamp axially along the rod to lift or lower the plank.

The threaded rod is rotated by a crank handle that engages the rod via cooperating engaging structures. In at least one embodiment, the crank handle has a downward pin that engages the rod which has a cooperating aperture at the top of the rod.

In at least one embodiment, the adjustment mechanism is affixed directly to the casket shell. This minimizes weight and space at the head of the casket. In another embodiment, the adjustment mechanism is affixed to a mounting wall that vertically engages the head portion of the casket shell.

BRIEF DESCRIPTION OF THE DRAWINGS

The subject matter, which is regarded as the invention, is particularly pointed out and distinctly claimed in the concluding portion of this specification. The invention may best be understood by reference to the following description taken in connection with the accompanying drawings.

DETAILED DESCRIPTION OF THE PREFERRED EMBODIMENTS

Figure 1:
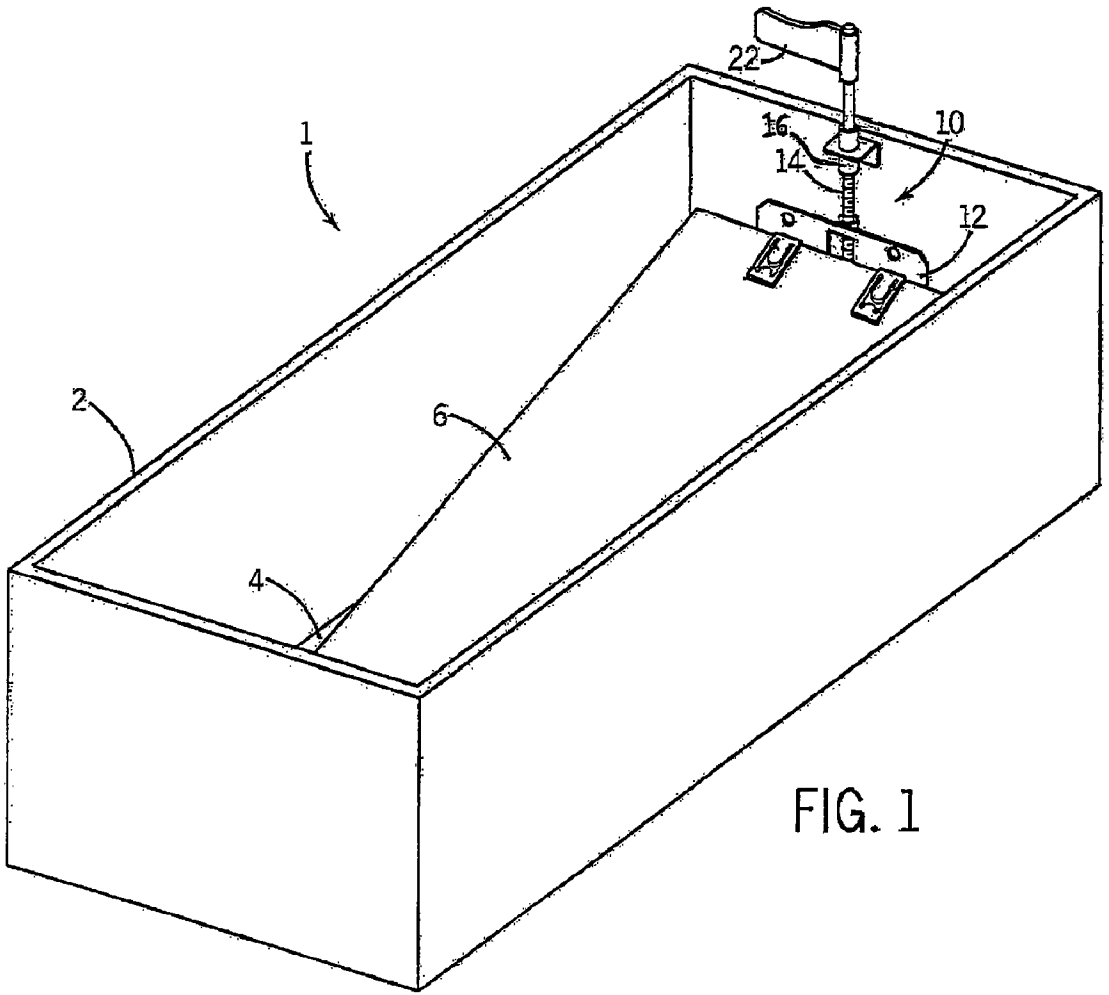
FIG. 1 is an isometric view of one embodiment of a crematable adjustable temporary casket according to the present invention showing a plank tiltably mounted on an adjustment mechanism, nested into a casket shell.

For the purpose of promoting an understanding of the principles of the invention, references will be made to the embodiment illustrated in the drawings. Specific language will also be used to describe the same. It will, nevertheless, be understood that no limitation of the scope of the invention is thereby intended, such alterations and further modifications in the illustrated device, and such further applications of the principles of the invention illustrated herein being contemplated as would normally occur to one skilled in the art to which the invention relates.

Referring now to FIG. 1, the invention provides a casket shell 2 having a floor 4. The casket shell 2 is substantially box-shaped, and is commonly constructed of cardboard. The casket shell 2 fits into a traditional casket, allowing adjustment of a deceased person to appear sleeping. A plank 6 overlies the floor 4, being tiltable thereto. The plank 6 may be constructed of wood or another combustible material. The combustibility of the casket shell and the plank allows a deceased person to be cremated without having to remove the body, or the adjustment devices, from the casket shell.

Figure 2:
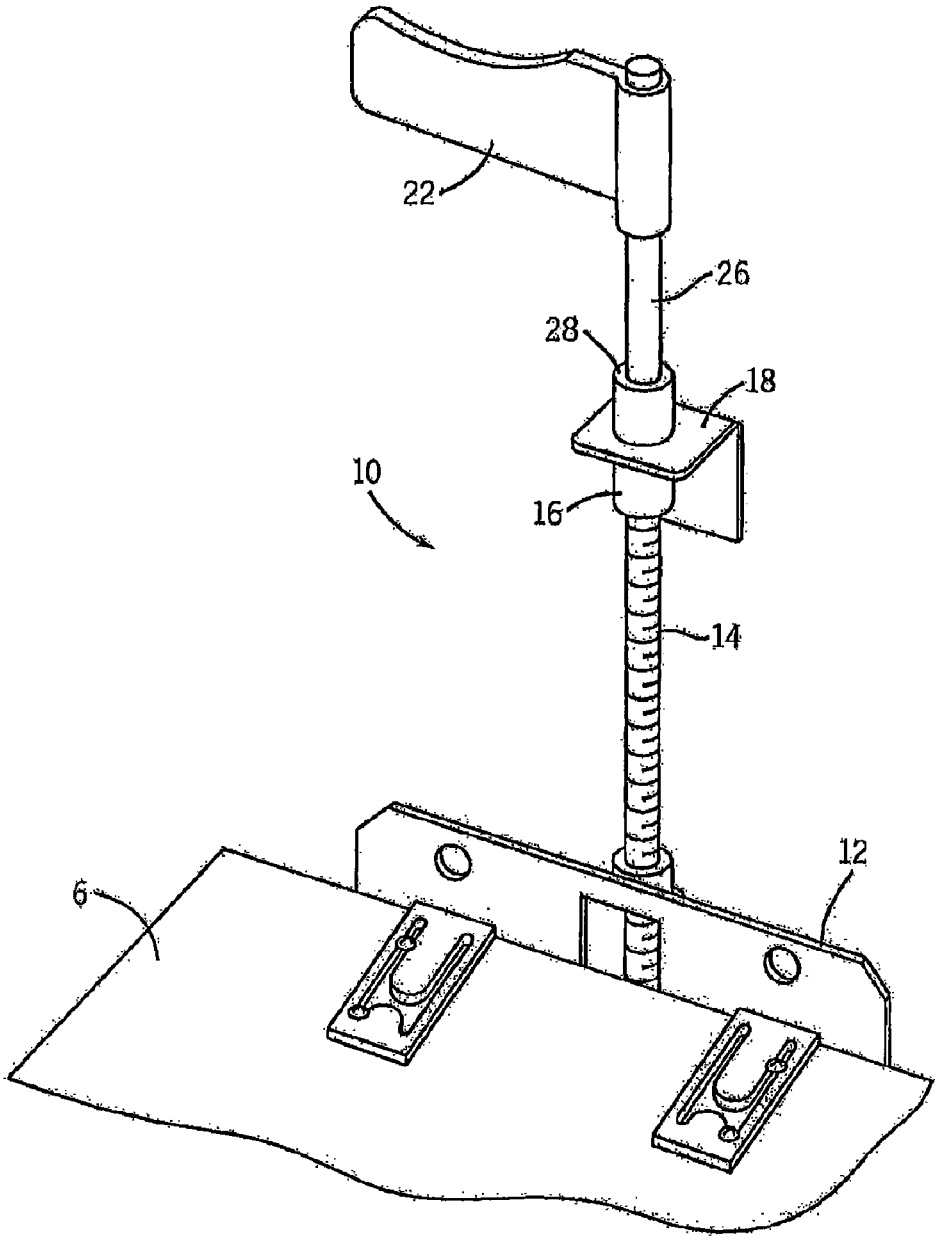
FIG. 2 is a perspective view of the adjustment mechanism, according to the present invention.

As shown in FIG. 2, an adjusting mechanism 10 is affixed by a clamp 12 to the plank 6. The adjusting mechanism 10 is able to adjust the tilt angle defined between the plank and the casket shell floor. The adjusting mechanism 10 has a threaded rod 14 that is vertically engageable with a clamp 12, allowing the threaded rod 14 to be rotatable for moving the clamp 12 axially along the length of the rod 14. There is a stopper device 16 attached proximal to the top end of the threaded rod 14, the stopper device 16 limits the distance the clamp 12 can move axially along the threaded rod 14. The stopper device 16 also has a concentrical housing 18 that maintains the threaded rod 14 in a generally upright position, and is affixed either to the casket shell 2 directly or to a mounting wall 20. The stopper device 16 prevents the plank from being tilted beyond a particular angle and is also responsible for maintaining the threaded rod 14 in a vertical position.

Figure 3:
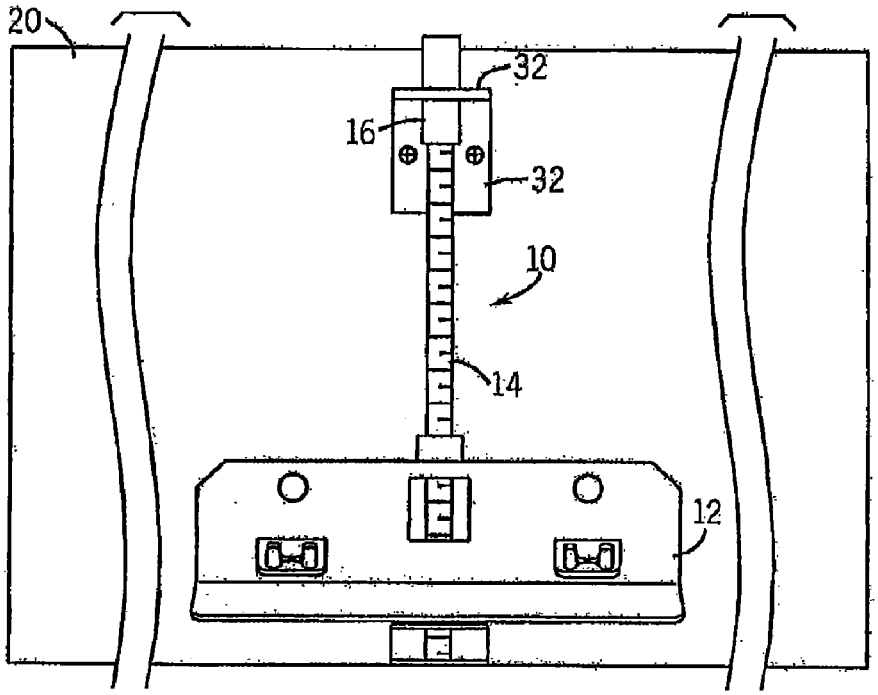
FIG. 3 is a front view of another embodiment of the adjustment mechanism according to the present invention, mounted to a mounting wall.
Figure 4:
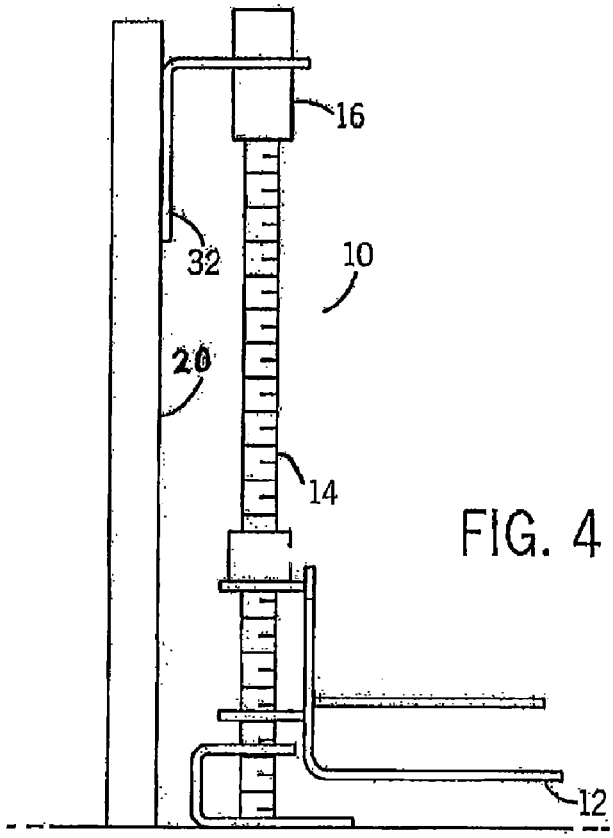
FIG. 4 is a perspective view of the embodiment of the adjustment mechanism shown in FIG. 3.

Alternatively, as illustrated in FIGS. 3 and 4, the threaded rod 14 can be mounted with an L-shaped clamp 32 that is concentrically affixed to the stopper device 16. The threaded rod 14 is axially rotated by the use of a crank handle 22 removably attached to the threaded rod 14. The crank handle 22 and the threaded rod 14 have cooperating engaging structures for locking the crank handle 22 and threaded rod 14 into rotational unison with each other, wherein the crank handle 22 includes a pin 26 and the threaded rod 14 includes an aperture 28. The mounting wall 20 is pressed against a side of the casket shell 2, at the head of the deceased person 24.

Figure 5:
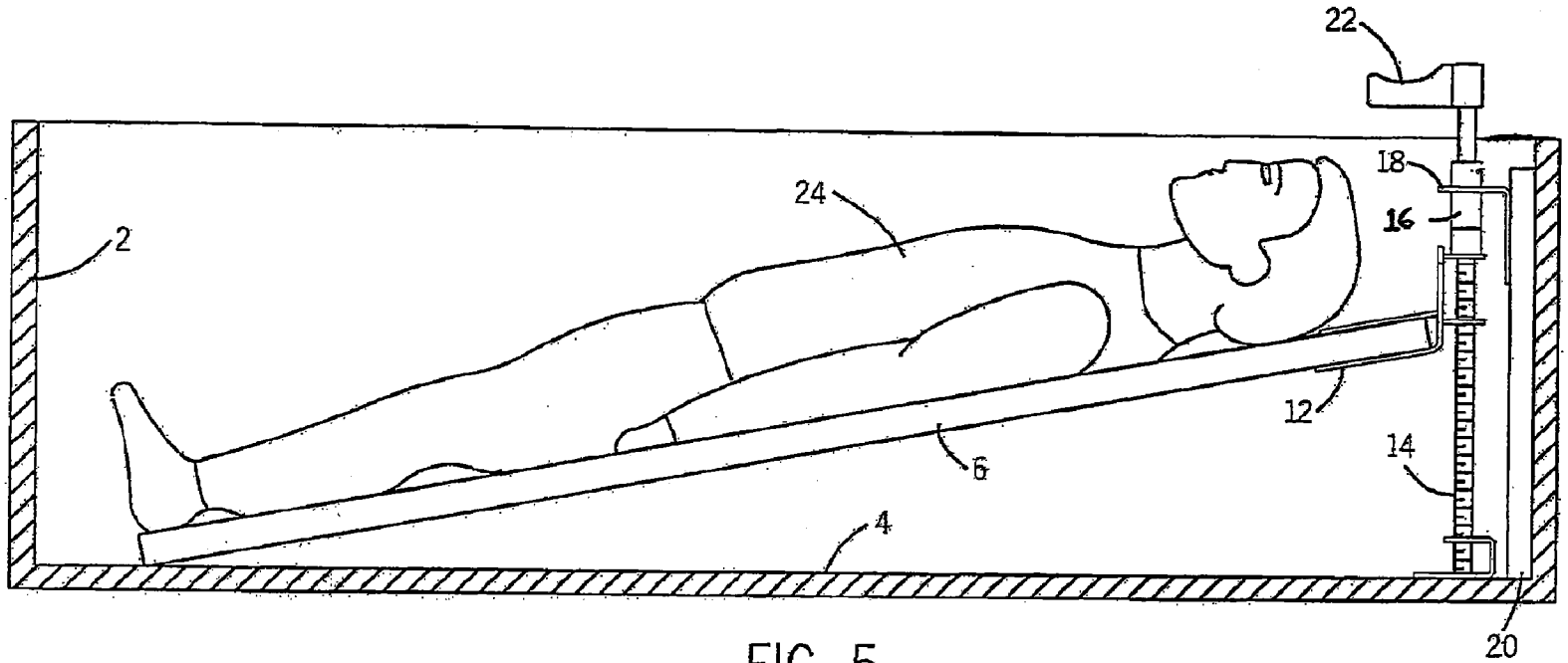
FIG. 5 is a side cross-sectional view of the crematable adjustable temporary casket, adjusted to show a deceased person in a more restful state for a visitation or funeral.

Referring to FIG. 5, the adjustment mechanism 10 is used so that the deceased person's 24 head and torso are moved upwardly, from the floor 4 of the casket shell 2. This allows visitors or family to view the deceased 24 in a more pleasant angle. It is extremely disconcerting and upsetting to have to look down into the casket and see a person lying flat on the floor 4 of the casket shell 2. Likewise, the adjustment mechanism 10 is sufficiently thin or small enough that traditional casket 34 linens cover the threaded rod 14 and stopper device 16, such that the family members do not see the mechanism 10.

After a funeral service, the funeral director lowers the plank 6 by rotating the threaded rod 14 via the crank handle 22. The deceased person 24 is lowered into the casket shell 2, so that the traditional casket 34 can be closed. When the family and friends have left, the funeral director removes the casket shell 2, inclusive of the deceased 24, the plank 6, and the adjustment mechanism 10. The crematable temporary adjustable casket 1, holding the deceased 24, is then transported to a crematorium or incinerator facility.

Figure 6:
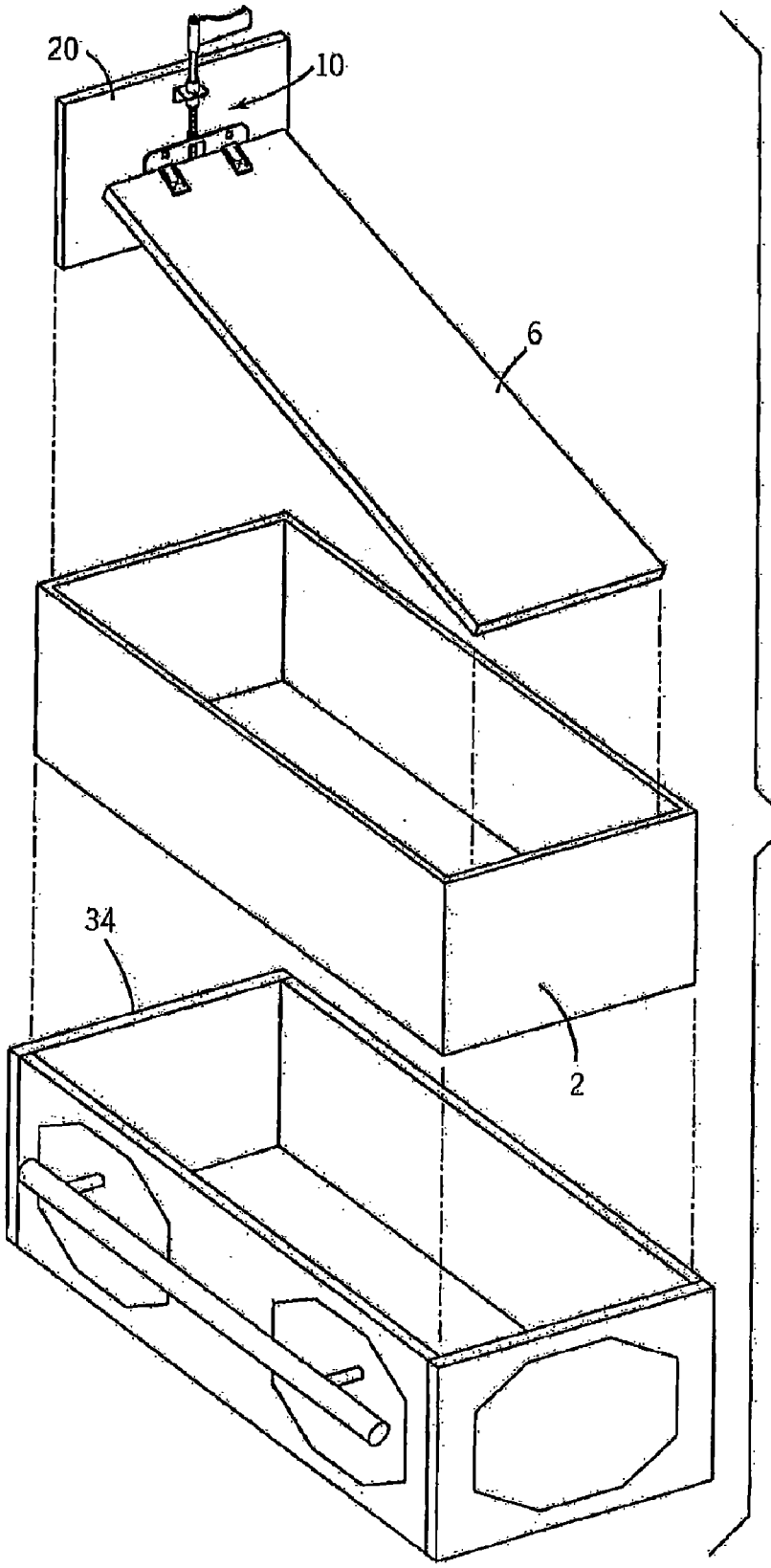
FIG. 6 is an exploded perspective view of a temporary casket assembly, showing the traditional casket with a temporary casket shell and an adjustment mechanism with a plank.

As illustrated in FIG. 6, the plank 6 with the adjustment mechanism 10 is nested within the casket shell 2. The casket shell in turn is nested into any sort of traditional casket 34. This allows a bereaved family to choose any traditional casket 34 for the visitation, but needs not purchase a casket for that purpose. The casket shell 2 protects the traditional casket 34, while still allowing the funeral director to position the deceased in a respectful resting state.

The temporary adjustable casket 1 can be used as a container for the deceased 24 during cremation. The materials to make the casket 1 are fully incinerated. After cremation, the adjustment mechanism 10 may be easily separated from the cremains. Alternatively, prior to cremation, the adjustment mechanism 10 and mounting wall 20 can be easily removed from the plank 12, and slid out from the temporary casket shell 2.

I claim:

1. A crematable adjustable temporary casket, comprising:

a casket shell having a floor and at least two sides extending upwardly from the floor;

a plank overlying the floor and being tiltable with respect thereto;

a mounting wall abutted to an interior surface of one of the casket shell sides;

an adjusting mechanism for adjusting a tilt angle defined between the plank and the casket shell floor, the adjusting mechanism including a clamp affixed to an end of the plank;

a threaded rod engaging the clamp and being rotatable for moving the clamp axially along a length thereof;

a stopper assembly including a stopper device attached proximal to a top end of the threaded rod and limiting a distance that the clamp travels axially along the threaded rod, and a concentrical housing maintaining the threaded rod in a generally upright position and affixed to the mounting wall;

and a crank handle removably attached to the threaded rod; and wherein the casket shell, plank and mounting wall are fully combustible.

2. The crematable adjustable temporary casket according to claim 1, wherein the crank handle and the threaded rod have cooperating engaging structures for temporarily locking the crank handle and threaded rod into rotational unison with each other.

3. The crematable adjustable temporary casket according to claim 1, wherein at least one of the clamp, the treaded rod, stopper device, and crank handle remains in the temporary crematable casket during a cremation process.

4. The crematable adjustable temporary casket according to claim 3, wherein the entire adjusting mechanism remains in the casket shell during a cremation process.

5. The crematable adjustable temporary casket according to claim 1, wherein the plank, the casket shell, the mounting wall, and the adjustment mechanism remain with a deceased person during a cremation process.

6. The crematable adjustable temporary casket according to claim 1, wherein the crank handle includes a pin as an engaging structure and wherein the threaded rod includes an aperture as an engaging structure.

7. The crematable adjustable temporary casket according to claim 1, wherein the casket shell is made of cardboard.

8. The crematable adjustable temporary casket according to claim 1, wherein the plank and the mounting wall are made of wood.

9. The crematable adjustable temporary casket according to claim 1, wherein the adjusting mechanism is removable from the plank.

10. The crematable adjustable temporary casket according to claim 1, wherein the casket shell fits into a traditional casket, allowing adjustment of a deceased person to appear sleeping.

11. A method for cremation of a deceased person, the steps comprising:

providing a temporary casket including a traditional casket encasing a cardboard casket shell having a substantially box-shaped configuration including a floor, a combustible plank set within the casket shell and overlying the floor, and an adjustment mechanism for adjusting a tilt angle defined between the plank and the casket shell floor;

positioning the deceased person on the plank;

adjusting a position of the deceased person by adjusting the tilt angle of the plank by way of the adjustment mechanism so that the person lies flat within the casket shell;

removing the casket shell from the traditional casket;

inserting the casket shell into a retort chamber of a cremator;

operating the cremator and substantially combusting the cardboard casket shell and the plank;

removing the cremains from the retort chamber; and separating the adjustment mechanism from the cremains.

* * * * *